US006707239B2

(12) United States Patent
Nagata et al.

(10) Patent No.: US 6,707,239 B2
(45) Date of Patent: Mar. 16, 2004

(54) ARC TUBE INCLUDING STEP-DOWN PLANE PORTIONS IN PINCH SEAL AREA

(75) Inventors: Akihiro Nagata, Shizuoka (JP); Hiroshi Goto, Shizuoka (JP); Yoshitaka Ohshima, Shizuoka (JP); Shinichi Irisawa, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 09/995,562

(22) Filed: Nov. 29, 2001

(65) Prior Publication Data

US 2002/0067115 A1 Jun. 6, 2002

(30) Foreign Application Priority Data

Dec. 5, 2000 (JP) ..... P.2000-370610

(51) Int. Cl.[7] ..... H01J 5/50; H01J 17/18

(52) U.S. Cl. ..... 313/318.02; 313/318.02; 313/623; 313/573

(58) Field of Search ..... 313/623, 624, 313/625, 626, 573, 634, 318.02, 283; 445/43, 45

(56) References Cited

U.S. PATENT DOCUMENTS 5,142,195 A * 8/1992 Heider et al. ..... 313/623
5,825,129 A * 10/1998 Van der Leeuw et al. .. 313/634
5,877,590 A 3/1999 Fukuyo et al. ..... 313/623
5,936,349 A 8/1999 Fukai et al. ..... 313/623
5,962,976 A 10/1999 Irisawa et al. ..... 313/623
6,452,334 B1 * 9/2002 Ohshima et al. ..... 313/623
6,583,565 B2 * 6/2003 Nishida et al. ..... 313/634

* cited by examiner

*Primary Examiner*—Nimeshkumar D. Patel
(74) *Attorney, Agent, or Firm*—Sughrue Mion, PLLC

(57) ABSTRACT

An arc tube that effectively prevents a metal halide from being deposited in a light emitting tube portion, causing the change of a light emitting color or the generation of lighting failures in an arc tube.

An axial distance L1 from a neck portion 20C of an arc tube body formed between a light emitting tube portion 20A and a pinch seal portion 24B of the arc tube body to a step-down plane portion 20Ba2 of each pinch seal surface 20Ba in a pinch seal portion 20B is set to 1 mm or less. During pinch seal, consequently, a sufficient pinching pressure is applied to a electrode 26, such as a tungsten electrode up to a portion close to a tip portion thereof. Thus, it is possible to reduce the volume of an almost wedge-shaped slit 24*a* formed around the tungsten electrode 26 on an end in the axial direction of a discharge space 24, thereby decreasing the amount of a metal halide deposited on the slit 24*a*.

4 Claims, 11 Drawing Sheets

CHROMATICITY DIAGRAM ( NO SLIT )

CHROMATICITY DIAGRAM ( WITH SLIT )

PREFERABLE CHROMATICITY RANGE

MEAN VALUE

ARC TUBE INCLUDING STEP-DOWN PLANE PORTIONS IN PINCH SEAL AREA

BACKGROUND OF THE INVENTION

1. Field of the Invention

The present invention relates to an arc tube of a discharge bulb which is to be used as a light source of a headlamp for a vehicle, and a method of manufacturing the arc tube.

2. Description of the Related Art

In recent years, an arc tube has often been used as a light source of a headlamp for a vehicle because it can carry out irradiation with a high luminance. As shown in FIG. 12, an arc tube to be used in a headlamp for a vehicle generally comprises an arc tube body 104 formed of quartz glass in which a pinch seal portion 104*b* is provided on both sides of a light emitting tube portion 104*a* forming a discharge space 102. The arc tube includes a pair of electrode assemblies 106 having a tungsten electrode 108 and a lead wire 110 coupled and fixed to each other through a molybdenum foil 112. Each electrode assembly 106 is pinch sealed with the arc tube body 104 in each pinch seal portion 104*b* such that the tip portion of the tungsten electrode 108 is protruded toward the discharge space 102. A metal halide is enclosed in addition to an inactive gas and mercury in the discharge space 102 of the arc tube in order to enhance a color rendering property during lighting.

Since the arc tube body 104 is formed by performing a thermal process on a quartz glass tube, an almost wedge-shaped slit 102*a* is inevitably formed around each tungsten electrode 108 on both ends in the axial direction of the discharge space 102. In each slit 102*a*, a temperature during the lighting of the arc tube is lower than that in the other portions of the discharge space 102. Therefore, a metal halide is easily deposited on the slit 102*a*. As shown in FIG. 12, the metal halide 114 deposited on each slit 102*a* does not contribute to light emission during the lighting of the arc tube. Therefore, there is a problem in that the light emitting color of the arc tube is changed to be a different color from a predetermined color. Moreover, when the amount of the metal halide 114 deposited on each slit 102*a* is increased to some degree, the metal halide which can be effectively used for the lighting of the arc tube becomes insufficient so that there is also a problem in that lighting failures are caused.

SUMMARY OF THE INVENTION

The invention has been made in consideration of such circumstances and has an object to provide an arc tube capable of effectively suppressing the change of a light emitting color and the generation of lighting failures due to the deposition of the metal halide on the slit. In order to achieve the object, the present invention includes a structure of an arc tube body that reduces the volume of a slit, thereby decreasing the amount of deposition of a metal halide.

More specifically, in a first aspect of the invention, an arc tube may comprise an arc tube body including a light emitting tube portion forming a discharge space, a pinch seal portion disposed on sides of the light emitting tube portion, and a neck portion disposed between the light emitting tube portion and the pinch seal portion. Further, a pair of electrodes are pinch sealed with the arc tube body at the pinch seal portion such that a tip portion of each of the pair of electrodes protrudes towards the discharge space, wherein each of a pair of opposing pinch seal surfaces of the pinch seal portion include a general portion and a step-down plane portion formed to have a substantially planar shape in step-down with respect to the general portion, and wherein an axial distance from the neck portion to the step-down plane portion is 1 mm or less.

Moreover, in a second aspect of the invention the arc tube may comprise an arc tube body including a light emitting tube portion forming a discharge space, a pinch seal portion diposed on sides of the light emitting tube portion, and a neck portion disposed between the light emitting tube portion and the pinch seal portion. Further, a pair of electrodes is pinch sealed with the arc tube body at the pinch seal portion such that a tip portion of each of the pair of electrodes protrudes towards the discharge space, wherein an axial distance measured in a direction going away from the light emitting tube portion from the neck portion to a tip of a substantially wedge-shaped slit formed between the arc tube body and at least one of the pair of electrodes is 0.5 mm or less.

Further, a method of manufacturing an arc tube is disclosed in which the method comprises forming an arc tube body of quartz glass which is provided with a pinch seal portion on both sides of a light emitting tube portion forming a discharge space and a neck portion between the light emitting tube portion and the pinch seal portion, and a pair of tungsten electrodes which are pinch sealed with the arc tube body in the pinch seal portion such that a tip portion is protruded toward the discharge space, wherein the pinch seal is carried out by using a pair of pinchers having a step-up plane portion for forming a step-down plane portion in the pinch seal portion and causing an edge on the light emitting tube portion side in the step-up plane portion of each of the pinchers to abut on the arc tube body in a position from a position where the neck portion is to be formed by an axial distance of 1 mm or less.

In the discussion of the invention, a "tungsten electrode" is disclosed which includes an electrode that contains tungsten as a principal component.

Further, the "axial distance" discussed herein indicates a distance in the axial direction of the arc tube.

The "neck portion" discussed indicates a narrowed portion between the light emitting tube portion and the pinch seal portion and the position in the axial direction of the arc tube is specified as the most narrowed position.

In the first aspect of the invention, if the "step-down plane portion" is formed to have an almost planar shape in step-down with respect to the general portion, a specific structure such as a contour shape thereof or the amount of step-down with respect to the general portion is not particularly restricted.

The setting of range of the "axial distance" in each invention may be applied to both of the pinch seal portions on both sides of the light emitting tube portion or may be applied to only one of them.

In the structure described above, the arc tube according to the first aspect of the invention has such a structure that each of a pair of pinch seal surfaces of the pinch seal portion formed in the arc tube body which are opposed to each other includes a general portion and a step-down plane portion formed to have an almost planar shape in step-down with respect to the general portion, and an axial distance from the neck portion to the step-down plane portion of the pinch seal surface in the pinch seal portion is set to have a value of 1 mm or less.

More specifically, since the axial distance from the neck portion to the step-down plane portion of each pinch seal surface in the pinch seal portion is very short, a sufficient pinching pressure can be applied to the tungsten electrode up to a portion close to the tip portion thereof during the pinch seal. As a result, it is possible to reduce the volume of the almost wedge-shaped slit formed on both ends in the axial direction of the discharge space. Therefore, the amount of the metal halide deposited on the slit can be reduced so that the change of the light emitting color of the arc tube and the generation of lighting failures can be suppressed effectively.

In the arc tube according to the second aspect of the invention, moreover, an axial distance in such a direction as to go away from the light emitting tube portion from the neck portion of the arc tube body to a tip of an almost wedge-shaped slit formed on both ends in an axial direction of the discharge space is set to have a value of 0.5 mm or less.

More specifically, since the axial distance from the neck portion to the tip of the slit is very short, the volume of the slit can be reduced. Consequently, the amount of the metal halide deposited on the slit can be reduced so that the change of the light emitting color of the arc tube and the generation of lighting failures can be suppressed effectively.

In the method of manufacturing an arc tube according to the invention, furthermore, when pinch sealing the tungsten electrode in the pinch seal portion of the arc tube body, the pinch seal is carried out by using a pair of pinchers having a step-up plane portion for forming a step-down plane portion in the pinch seal portion and causing an edge on the light emitting tube portion side in the step-up plane portion of each of the pinchers to abut on the arc tube body in a position from a position where the neck portion is to be formed by an axial distance of 1 mm or less.

More specifically, since the edge on the light emitting tube portion side in the step-up plane portion of the pincher abuts on the arc tube body in a very close position to the position where the neck portion is to be formed during the pinch seal, a sufficient pinching pressure can be applied to the tungsten electrode up to a portion close to the tip portion thereof. Consequently, since the volume of the almost wedge-shaped slit formed on both ends in the axial direction of the discharge space can be reduced, the amount of the metal halide deposited on the slit can be decreased. As a result, the change of the light emitting color of the arc tube and the generation of lighting failures can be suppressed effectively.

DETAILED DESCRIPTION OF THE INVENTION

Figure 1:
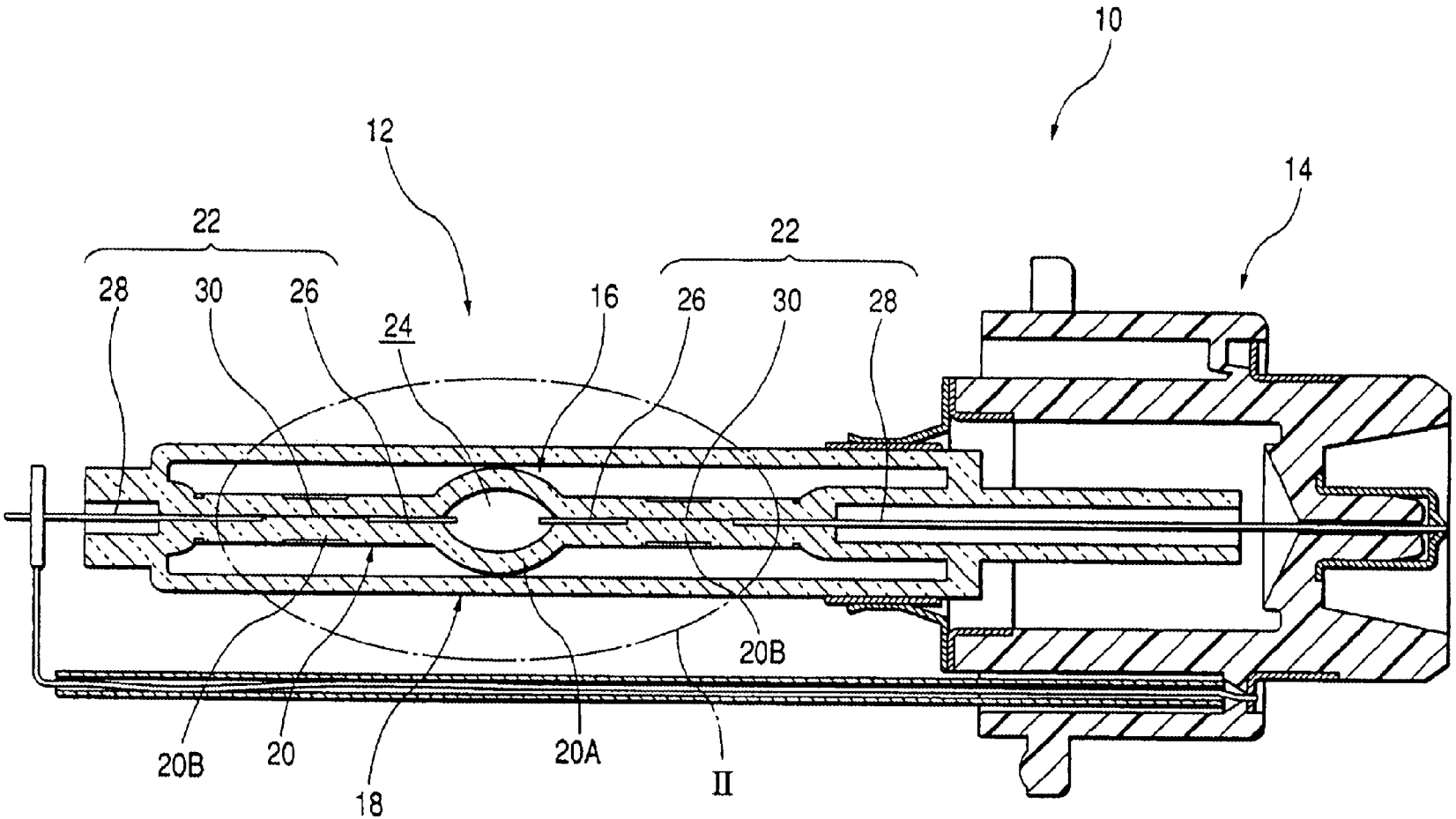
FIG. 1 is aside sectional view showing a discharge bulb having an arc tube according to an embodiment of the invention incorporated therein.
Figure 2:
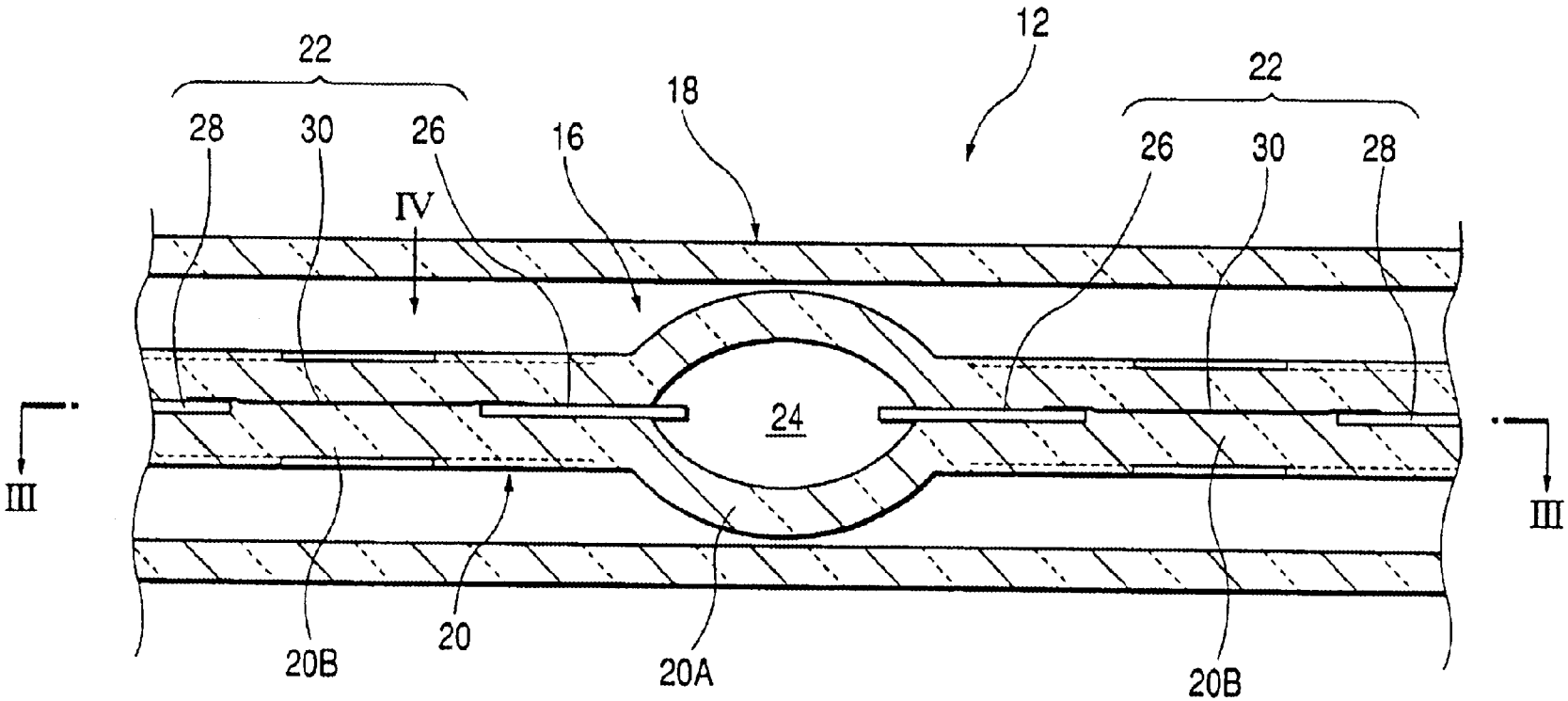
FIG. 2 is an enlarged view showing a II portion in FIG. 1.
Figure 3:
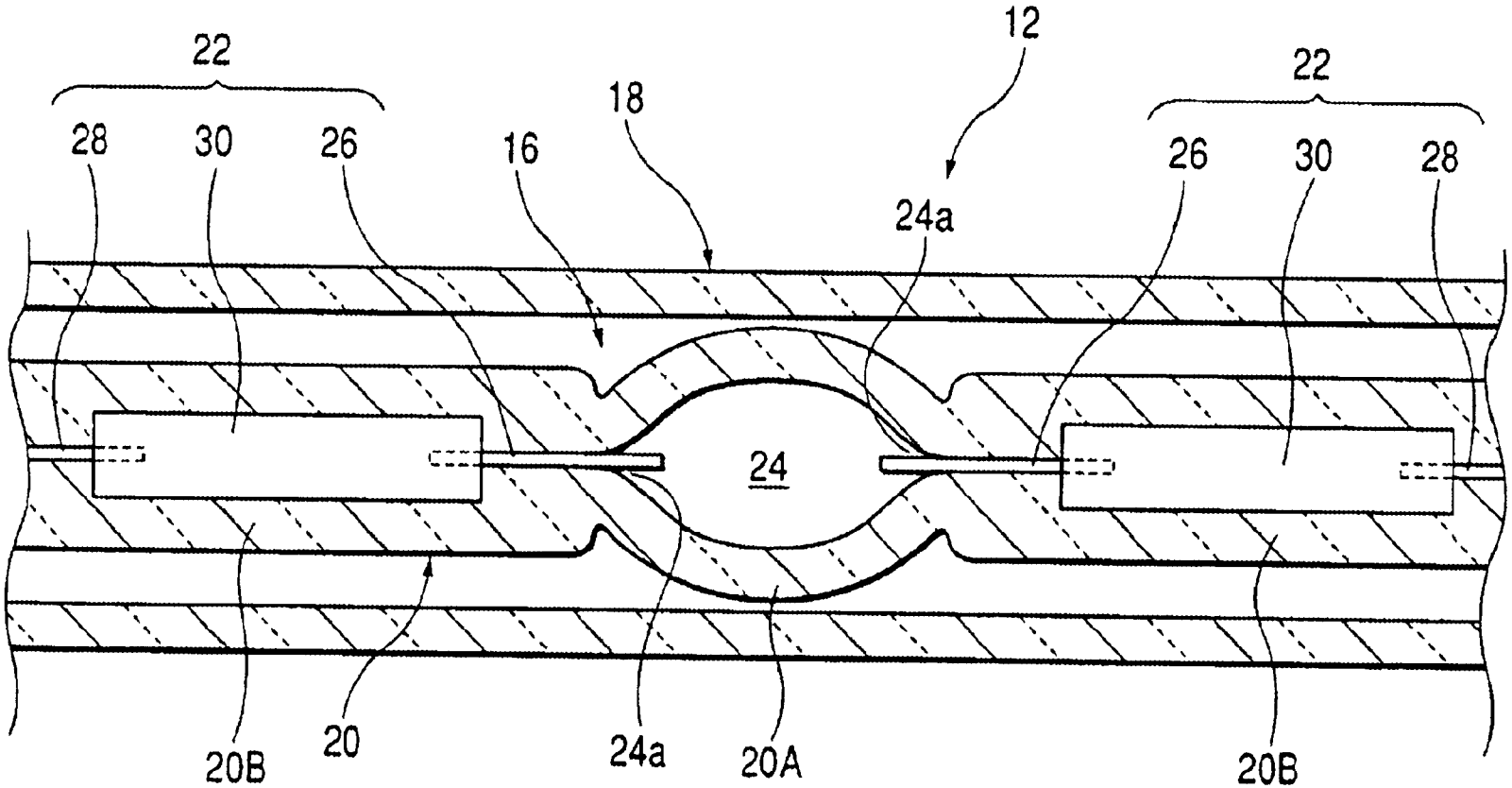
FIG. 3 is a sectional view taken along the line III—III in FIG. 2.

Embodiments of the invention will be described below with reference to the drawings. FIG. 1 is a sectional side view showing a discharge bulb 10 having an arc tube according to an embodiment of the present invention, and FIG. 2 is an enlarged view showing a II portion. FIG. 3 is a sectional view taken along the line III—III in FIG. 2.

As shown in the drawings, the discharge bulb 10 is a light source bulb to be attached to, for example, a headlamp of a vehicle and may comprise an arc tube unit 12 extended in a longitudinal direction and an insulating plug unit 14 for fixing and supporting the rear end of the arc tube unit 12.

The arc tube unit 12 may have an arc tube 16 and a shroud tube 18 surrounding the arc tube 16 which are formed integrally. The arc tube 16 is constituted by an arc tube body 20 obtained by processing a material such as a quartz glass tube and a pair of longitudinal electrode assemblies 22 embedded in the arc tube body 20. Of course, other materials for the arc tube and the electrodes may be substituted as known in the art.

The arc tube body 20 may contain an almost elliptic spherical light emitting tube portion 20A formed in a center, and a pinch seal portion 20B formed on both sides in front and rear portions thereof. An almost elliptic spherical discharge space 24 extended in a longitudinal direction may be formed in the light emitting tube portion 20A, and mercury, a xenon gas and a metal halide (for example, a metal iodide) may be enclosed with the discharge space 24.

In each electrode assembly 22, a bar-shaped tungsten electrode 26 and a lead wire 28 may be coupled and fixed through a molybdenum foil 30 by, for example, welding and pinch sealed with the arc tube body 20 in each pinch seal portion 20B. In that case, the tip portions of the respective tungsten electrodes 26 are protruded into the discharge space 24 to be opposed to each other on both longitudinal sides and portions other than the tip portions are embedded in the pinch seal portions 20B, and the whole molybdenum foil 30 is embedded in the pinch seal portion 20B.

Figure 4:
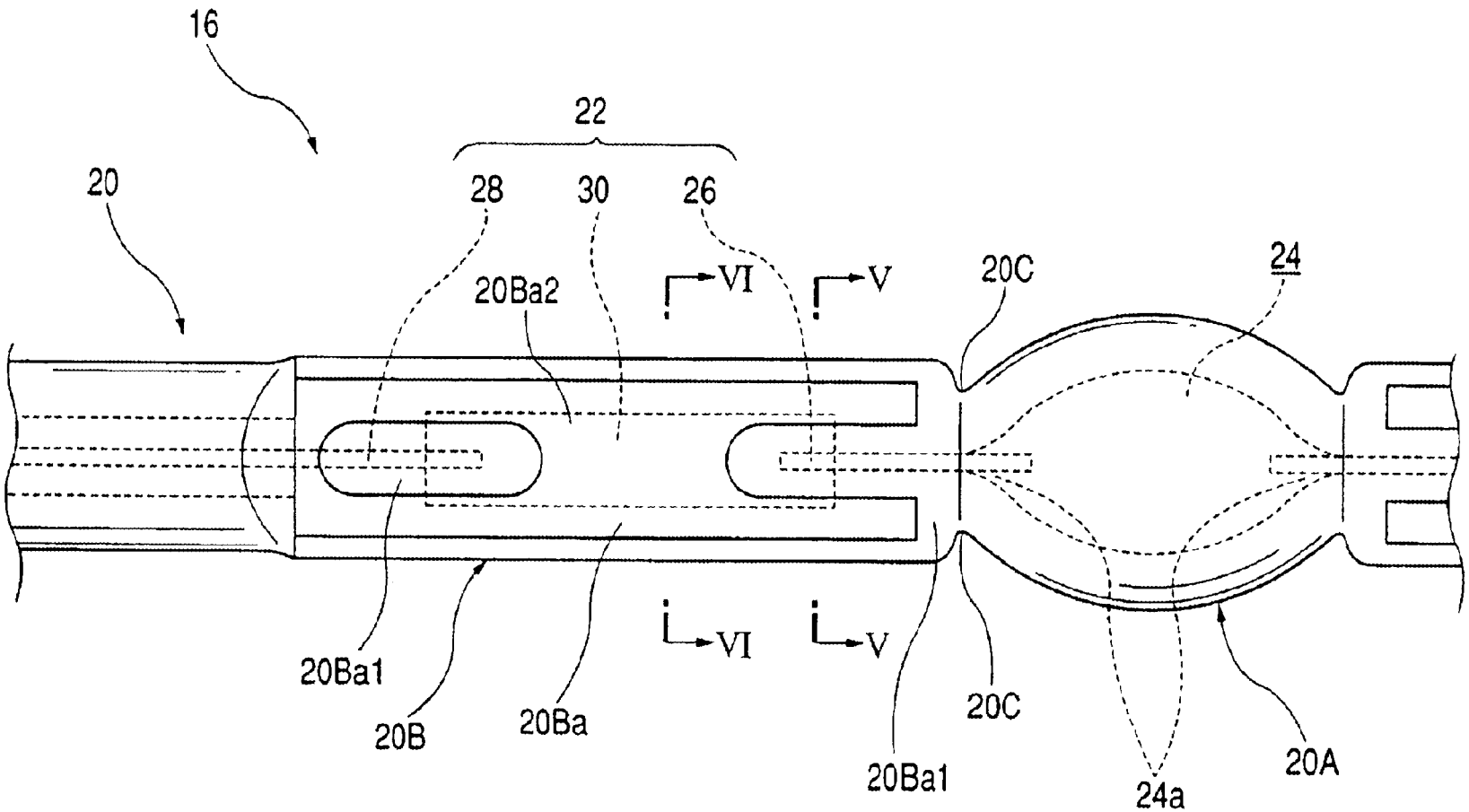
FIG. 4 is a view seen in a direction of IV in FIG. 2.
Figure 6:
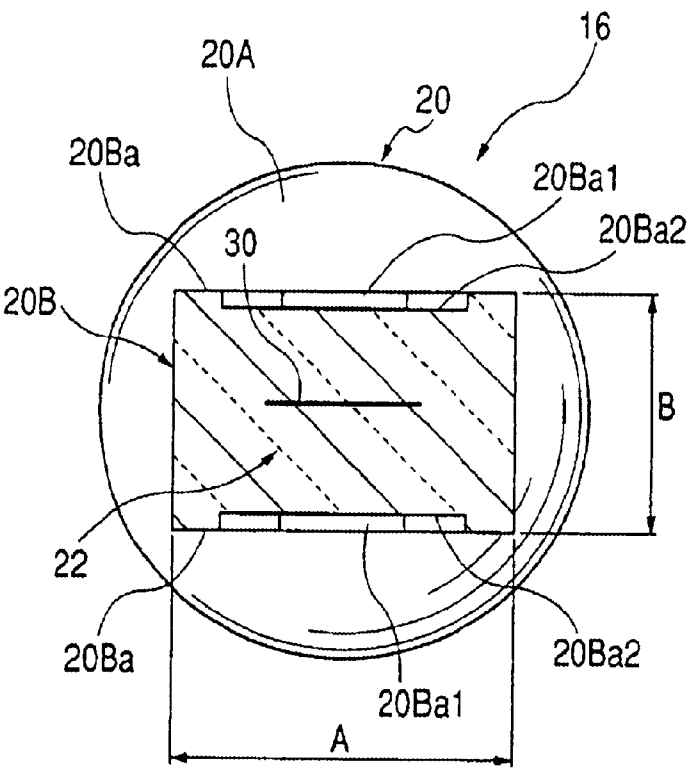
FIG. 6 is a sectional view taken along the line VI—VI in FIG. 4.
Figure 5:
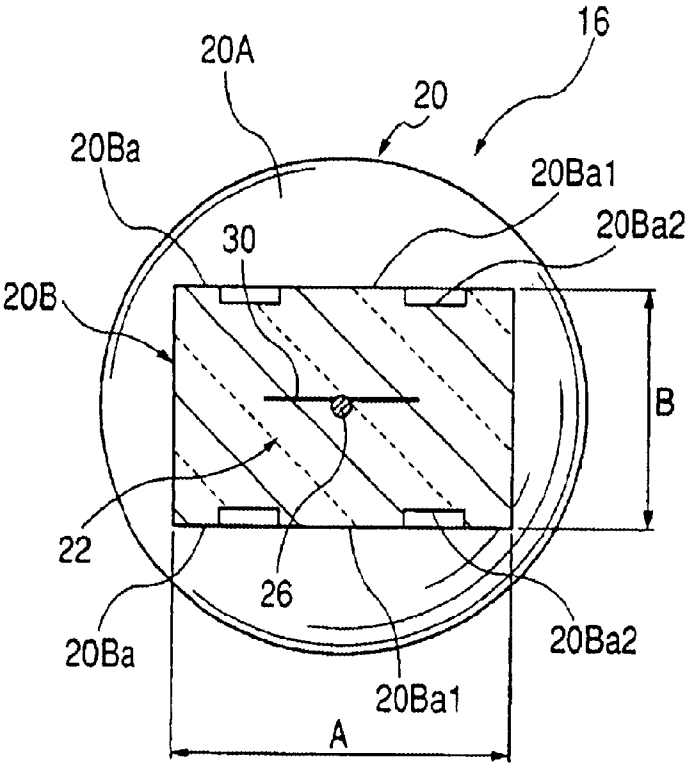
FIG. 5 is a sectional view taken along the line V—V in FIG. 4.

FIG. 4 is a view seen in a direction of IV—IV in FIG. 2, and FIGS. 5 and 6 are sectional views taken along the lines V—V and VI—VI in FIG. 4 respectively.

As shown in the drawings, the pinch seal portion 20B provided on the front side has an almost rectangular shape extended forward from the light emitting tube portion 20A seen in a plane and is formed with a slightly larger size than that of the molybdenum foil 30. A pair of right and left neck portions 20C are formed between the pinch seal portion 20B and the light emitting tube portion 20A. Since the pinch seal portion 20B provided on the rear side has the same structure, only the pinch seal portion 20B provided on the front side will be described below.

The pinch seal portion 20B may have a sectional shape set to be almost oblong rectangular, and both upper and lower surfaces 20Ba are constituted by general portions 20Ba1 and step-down plane portions 20Ba2 respectively.

The general portion 20Ba1 may be constituted by both right and left end regions and a rear end region in each of the upper and lower surfaces 20Ba, a U-shaped region extended in a longitudinal direction including the junction portion of the molybdenum foil 30 and the tungsten electrode 26, and an oval region extended in a longitudinal direction including the junction portion of the molybdenum foil 30 and the lead wire 28, and these regions are formed to be positioned on the same plane. The step-down plane portion 20Ba2 includes all regions other than the general portion 20Ba1 and is formed to have a step-down planar shape with respect to the general portion 20Ba1.

The pinch seal portion 20B has a thickness A set to A=3.8 to 4.6 mm and a thickness B set to B=1.8 to 2.2 mm. The width A represents a width dimension in a transverse direction and the thickness B represents a vertical dimension between the step-down plane portions 20Ba2 of both upper and lower surfaces 20Ba.

Figure 7:
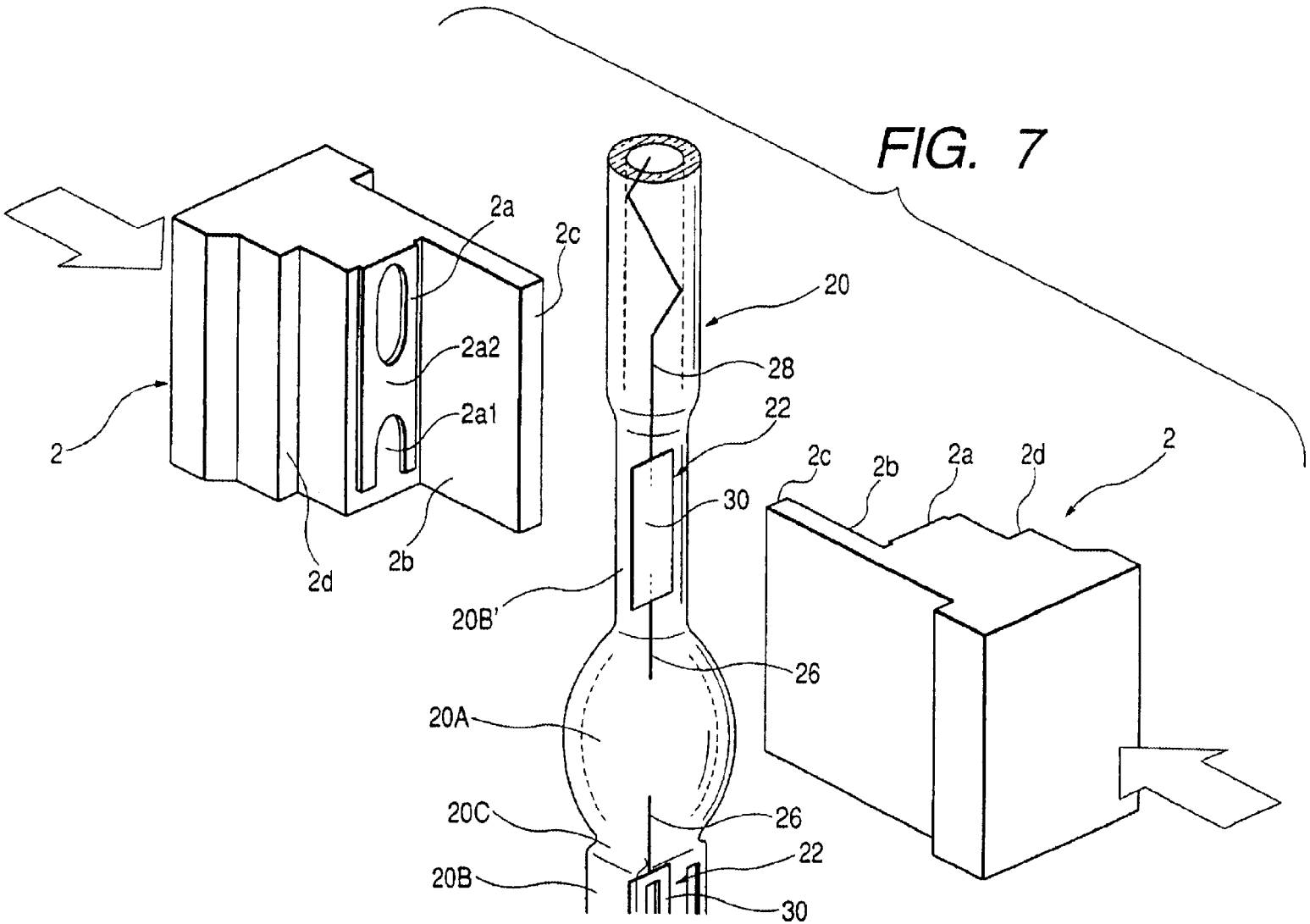
FIG. 7 is a perspective view showing a pinch seal step of forming a pinch seal portion on the front side of the arc tube.
Figure 8:
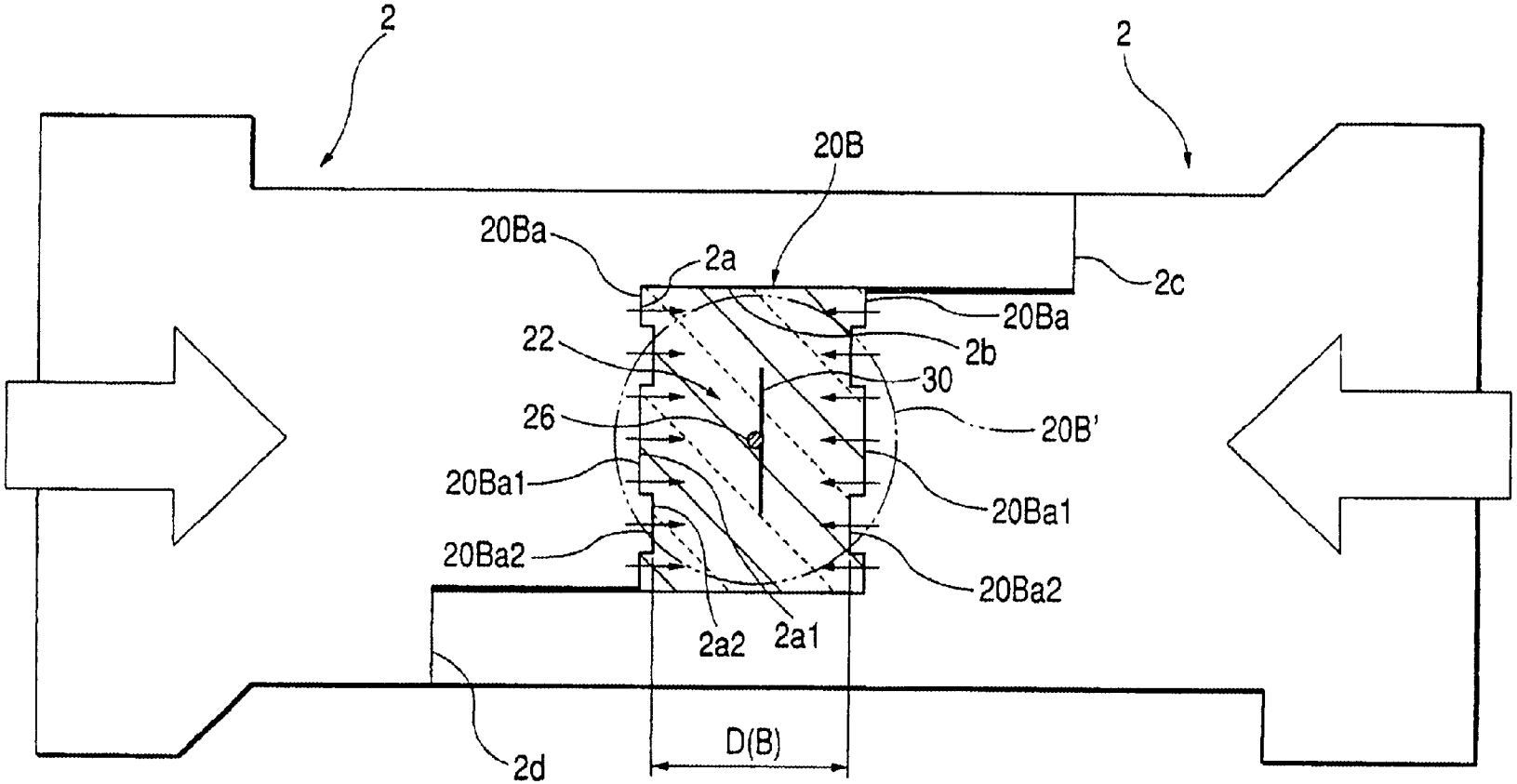
FIG. 8 is a sectional plan view showing the pinch seal step.

FIGS. 7 and 8 are a perspective view and a sectional plan view, which show a pinch seal step of forming the pinch seal portion 20B on the front side, respectively.

As shown in the drawings, at the pinch seal step, a pair of pinchers 2 are pressed, from both right and left sides, against a portion 20B' to be pinch sealed which is positioned above the light emitting tube portion 20A, thereby forming the pinch seal portion 20B in such a state that the arc tube body 20 having the pinch seal portion 20B formed on the rear side is provided with a front end thereof turned upward.

Both pinchers 2 have point symmetrical structures seen in a plane. Each of the pinchers 2 may be provided with a front surface portion 2*a* for forming the upper and lower surfaces 20Ba of the pinch seal portion 20B, a side surface portion 2*b* for forming both side surfaces of the pinch seal portion 20B, a stopper portion 2*c* for a butting on the other pincher during the pinch seal, and a stopper receiving portion 2*d* for receiving the stopper portion 2*c* of the other pincher. The front surface portion 2*a* of each pincher 2 is provided with a general portion 2*a*1 and a step-up plane portion 2*a*2 corresponding to the general portion 20Ba1 and the step-down plane portion 20Ba2 in each of the upper and lower surfaces 20Ba of the pinch seal portion 20B. A molding space is formed during the pinch seal by the abutment of the stopper portion 2*c* and the stopper receiving portion 2*d* in each pincher 2. At this time, the thickness B of the pinch seal portion 20B is determined by a spacing D(B) between the step-up plane portions 2*a*2 of the front surface portions 2*a* in the pinchers 2.

In order to prevent a crack from being generated due to a reduction in the thickness of the quartz glass in each junction portion of the molybdenum foil 30 and the tungsten electrode 26 and lead wire 28, the U-shaped region and the oval region are set to be the general portion 20Ba1 in each of the upper and lower surfaces 20Ba of the pinch seal portion 20B. By setting the U-shaped region and the oval region to be the general portion 20Ba1, the direction of the electrode assembly 22 (particularly, the tip portion of the tungsten electrode 26) can be prevented from being greatly shifted in a transverse direction with respect to an axis in a longitudinal direction.

Figure 9:
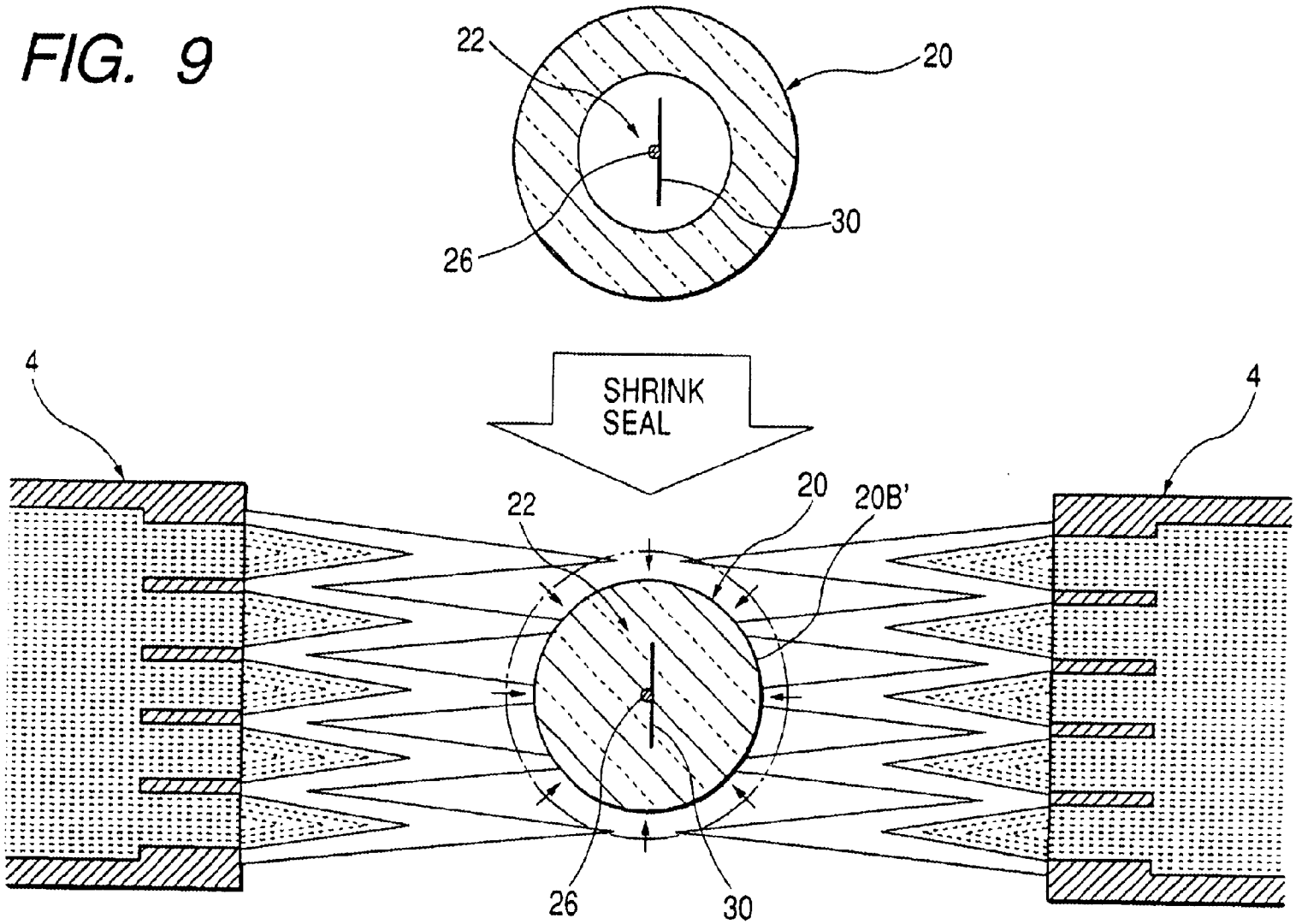
FIG. 9 is a sectional plan view showing a shrink seal step to be carried out before the pinch seal step.

The portion 20B' to be pinch sealed may have a solid structure with a smaller diameter than that of a general tubular hollow portion in the arc tube body 20 and have the electrode assembly 22 positioned and embedded therein. The portion 20B' to be pinch sealed may be formed by heating the arc tube body 20 having the electrode assembly 22 inserted therein by means of, for example, a pair of burners 4 on both right and left sides and thermally shrinking the arc tube body 20 over a predetermined length at a shrink seal step to be carried out before the pinch seal step as shown in FIG. 9.

As shown in FIGS. 3 and 4, the arc tube body 20 formed by the pinch seal is provided with an almost wedge-shaped slit 24*a* on both right and left sides of the tungsten electrode 26 on both ends in the axial direction of the discharge space 24. On the other hand, as shown in FIG. 2, the pressing force of the pincher 2 may directly act on both upper and lower sides of the tungsten electrode 26 on both ends in the axial direction of the discharge space 24 during the pinch seal. Therefore, such a slit 24*a* is rarely formed.

Figure 10:
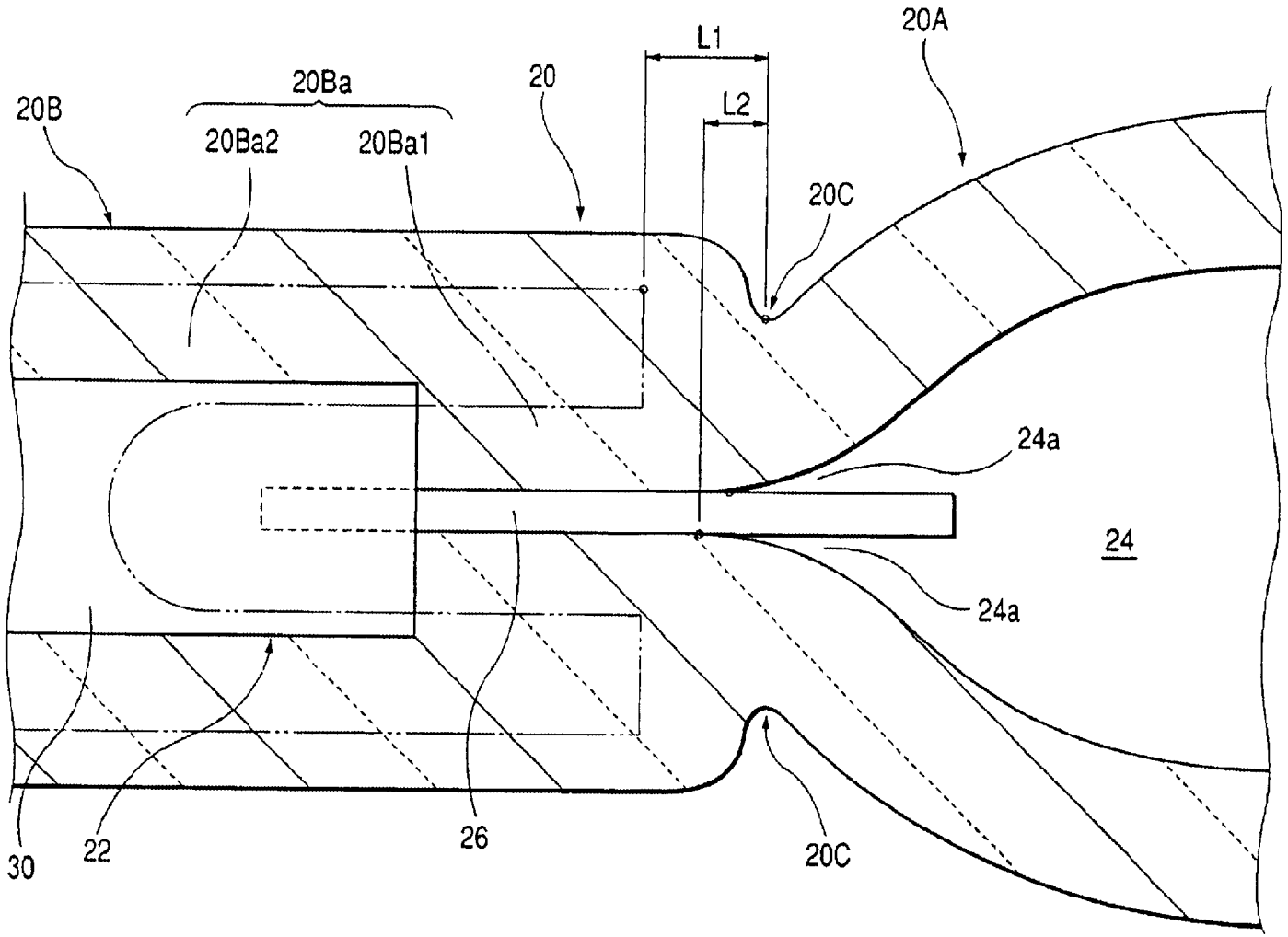
FIG. 10 is a view showing a main part of FIG. 3 in detail, FIGS. 11(*a*) and 11(*b*) are chromaticity diagrams showing the result of an experiment carried out to confirm the performance of the arc tube according to the embodiment.

FIG. 10 is a view showing a main part of FIG. 3 in detail. In FIG. 10, an axial distance L1 from the neck portion 20C to the step-down plane portion 20Ba2 of each pinch seal surface 20Ba in the pinch seal portion 20B is set to have a value (for example, L1=approximately 0.5 to 0.7 mm) which is equal to or smaller than 1 mm (more preferably, 0.75 mm). In order to implement the setting, at the pinch seal step, the pinch seal is carried out by causing the lower edge of the step-up plane portion 2*a*2 in the front portion 2*a* of each pincher 2 to abut on the arc tube body 20 in an upward position by 1 mm or less from a position where the neck portion 20C is to be formed.

By setting the axial distance L1 from the neck portion 20C to the step-down plane portion 20Ba2 of each pinch seal surface 20Ba in the pinch seal portion 20B to have a very small value, thus, a sufficient pinching pressure can be applied to the tungsten electrode 26 up to the portion close to the tip portion thereof during the pinch seal. As a result, as shown in FIG. 10, the slits 24*a* formed on both right and left sides of the tungsten electrode 26 have tips extended forward from the neck portion 20C (the side provided apart from the light emitting tube portion 20A), and an axial distance L2 from the neck portion 20C to the tip of the slit 24*a* has a value (for example, L2=0.1 to 0.2 mm) which is equal to or smaller than 0.5 mm. In a preferred embodiment, this value is 0.25 mm. Consequently, the volume of the slit 24*a* can be reduced so that the amount of a metal halide deposited on the slit 24*a* can be decreased. Thus, it is possible to effectively suppress the change of the light emitting color of the arc tube 16 and the generation of lighting failures.

In the conventional arc tube, the axial distance L1 from the neck portion 20C to the step-down plane portion 20Ba2 of each pinch seal surface 20Ba in the pinch seal portion 20B is set to L1=approximately 1.5 to 2.5 mm. As a result, the axial distance L2 from the neck portion 20C to the tip of the slit 24*a* is set to L2=approximately 0.75 to 2.0 mm.

Figure 11A:
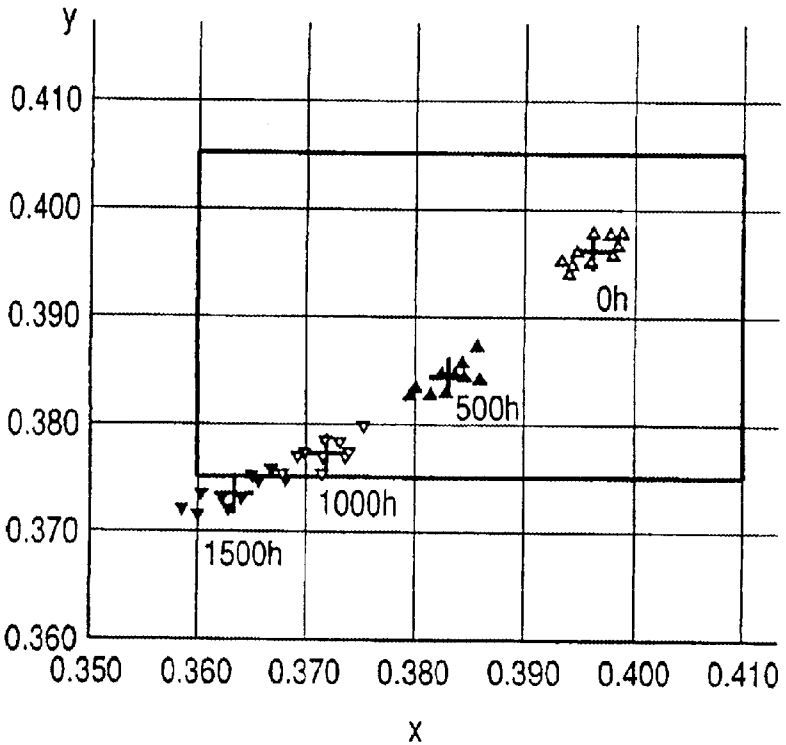
Figure 11B:
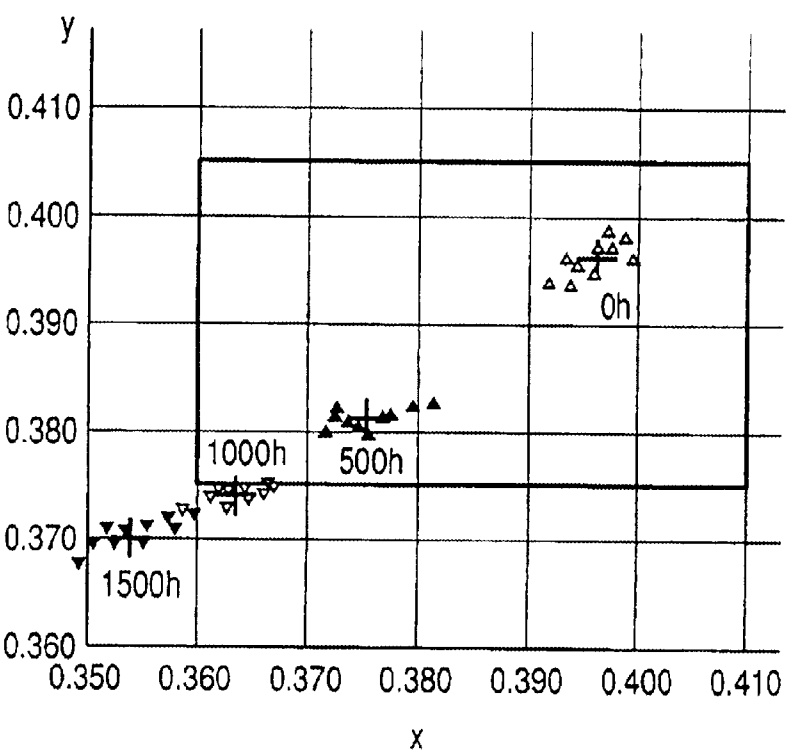
Figure 11B:
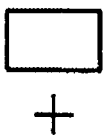
Figure 12:
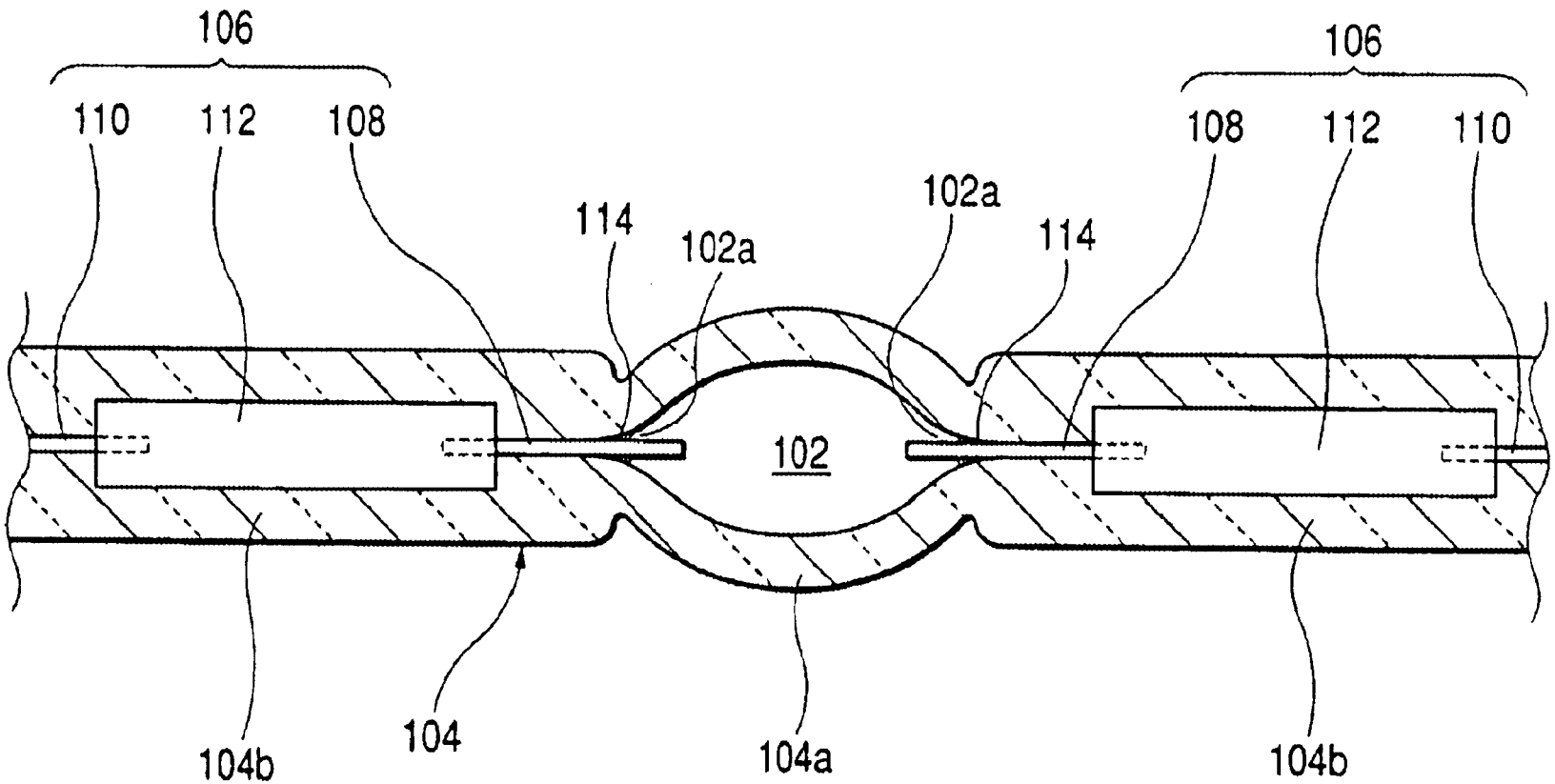
FIG. 12 PRIOR ART
FIG. 12 is a view showing a conventional example of an arc tube.

FIG. 11 is a chromaticity diagram showing the result of an experiment carried out to confirm the performance of the arc tube 16 according to the embodiment. In an experiment performed for the present invention, a chromaticity was measured with the passage of time in order to examine the change of a light emitting color which was obtained when the arc tube was continuously lighted. For a sample, ten arc tubes having no slit (L2<0.25 mm) and ten arc tubes having a slit (L2>0.75 mm) were prepared. The chromaticity was measured at a time of 0 hours, 500 hours, 1000 hours and 1500 hours after the lighting was started.

In FIG. 11, (a) indicates the result of the experiment for the arc tube having no slit and (b) indicates the result of the experiment for the arc tube having a slit. In the drawing, a mark "+" indicates the mean value of the ten samples. In FIG. 11, moreover, the range of the chromaticity shown in a rectangular frame ($0.360<x<0.410$, $0.375<y<0.405$) is preferable for the arc tube for a light source bulb which is to be attached to a headlamp for a vehicle.

In the result of the experiment, almost the same chromaticities are gained from the arc tube having no slit and the arc tube having a slit immediately after the start of the lighting, and the chromaticity of the arc tube having a slit is changed more greatly as compared with the arc tube having no slit if a lighting time is increased. The chromaticity of the arc tube having a slit deviates toward the lower left of the rectangular frame for almost all the samples in 1000 hours after the start of the lighting.

It can be considered that the chromaticity of the arc tube having a slit is greatly changed due to the deposition of the metal halide on the slit. If such a change in the chromaticity is caused, the light emitting color of the arc tube becomes too pale. In this respect, the chromaticity of the arc tube having no slit is not so changed and the light emitting color of the arc tube does not become too pale.

As described above in detail, in the arc tube 16 according to an embodiment of the present invention, the axial distance L1 from the neck portion 20C to the step-down plane portion 20Ba2 of each pinch seal surface 20Ba in the pinch seal portion 20B is set to have a value of 1 mm or less. During the pinch seal, therefore, the sufficient pinching pressure can be applied to the tungsten electrode 26 up to the portion close to the tip portion thereof. As a result, the axial distance L2 from the neck portion 20C to the tip of the slit 24*a* formed on both right and left sides of the tungsten electrode 26 can be set to have a value of 0.5 mm or less. Consequently, the volume of the slit 24*a* can be reduced so that the amount of the metal halide deposited on the slit 24*a* can be decreased.

According to present invention, therefore, it is possible to effectively suppress the change of the light emitting color of the arc tube 16 and the generation of lighting failures.

While the arc tube 16 of the discharge bulb 10 to be attached to a headlamp for a vehicle has been described in the embodiment, the same functions and effects as those in the embodiment can be obtained by employing the same structure as that in the embodiment for arc tubes to be used for other purposes.

What is claimed is:

1. An arc tube comprising:

an arc tube body including a light emitting tube portion forming a discharge space, a pinch seal portion disposed on sides of the light emitting tube portion, and a neck portion disposed between the light emitting tube portion and the pinch seal portion; and a pair of electrodes pinch sealed with the arc tube body at the pinch seal portion such that a tip portion of each of the pair of electrodes protrudes towards the discharge space, wherein each of a pair of opposing pinch seal surfaces of the pinch seal portion include a general portion and a step-down plane portion formed to have a substantially planar shape in step-down with respect to the general portion, and wherein an axial distance from the neck portion to the step-down plane portion is 1 mm or less.

2. The arc tube according to claim 1, wherein the arc tube body contains quartz glass and the pair of electrodes comprise a tungsten material.

3. An arc tube comprising:

an arc tube body including a light emitting tube portion forming a discharge space, a pinch seal portion diposed on sides of the light emitting tube portion, and a neck portion disposed between the light emitting tube portion and the pinch seal portion; and a pair of electrodes pinch sealed with the arc tube body at the pinch seal portion such that a tip portion of each of the pair of electrodes protrudes towards the discharge space, wherein an axial distance measured in a direction going away from the light emitting tube portion from the neck portion to a tip of a substantially wedge-shaped slit formed between the arc tube body and at least one of the pair of electrodes is 0.5 mm or less.

4. The arc tube according to claim 3, wherein the arc tube body contains quartz glass and the pair of electrodes comprise a tungsten material.

* * * * *